US011369222B2

(12) United States Patent
Kennett

(10) Patent No.: US 11,369,222 B2
(45) Date of Patent: Jun. 28, 2022

(54) SECURE PACKAGE DELIVERY CONTAINER AND METHOD

(71) Applicant: Kevin Kennett, Midland, MI (US)

(72) Inventor: Kevin Kennett, Midland, MI (US)

( * ) Notice: Subject to any disclaimer, the term of this patent is extended or adjusted under 35 U.S.C. 154(b) by 0 days.

(21) Appl. No.: 16/444,398

(22) Filed: Jun. 18, 2019

(65) Prior Publication Data

US 2020/0397172 A1 Dec. 24, 2020

(51) Int. Cl.

| | |
|---|---|
| ***A47G 29/14*** | (2006.01) |
| ***G07C 9/00*** | (2020.01) |
| ***E05B 47/00*** | (2006.01) |
| ***A47C 7/62*** | (2006.01) |

(52) U.S. Cl.

CPC ..... *A47G 29/141* (2013.01); *E05B 47/00* (2013.01); *G07C 9/00896* (2013.01); *A47C 7/628* (2018.08); *A47G 2029/145* (2013.01); *A47G 2029/147* (2013.01); *E05Y 2900/20* (2013.01); *G07C 2009/0092* (2013.01)

(58) Field of Classification Search

None

See application file for complete search history.

(56) References Cited

U.S. PATENT DOCUMENTS

| | | | | |
|---|---|---|---|---|
| 6,218,929 | B1 * | 4/2001 | Furuta | G07C 9/00309 340/10.1 |
| 6,412,688 | B1 | 7/2002 | Tucker et al. | |
| 7,518,485 | B2 | 4/2009 | Shuster | |
| 7,743,935 | B2 | 6/2010 | Maid | |
| 9,004,346 | B2 | 4/2015 | Farentinos et al. | |
| 9,327,887 | B2 | 5/2016 | Farentinos et al. | |
| 9,630,757 | B1 | 4/2017 | Capous | |
| 10,039,401 | B1 | 8/2018 | Romanucci | |
| 2001/0045449 | A1 | 11/2001 | Shannon | |
| 2004/0113437 | A1 * | 6/2004 | Hayakawa | E05B 81/16 292/201 |
| 2011/0057774 | A1 | 3/2011 | Van Rysselberghe | |
| 2015/0102903 | A1 | 4/2015 | Wilkinson | |
| 2016/0066733 | A1 | 3/2016 | Gozar | |
| 2016/0275449 | A1 * | 9/2016 | Hara | G06Q 10/0836 |
| 2017/0041451 | A1 * | 2/2017 | Wilkinson | H04W 4/027 |
| 2017/0278063 | A1 * | 9/2017 | Dixon | G06K 7/1413 |

(Continued)

*Primary Examiner* — Carlos Garcia

(74) *Attorney, Agent, or Firm* — Dean W. Amburn; Amburn Law PLLC

(57) ABSTRACT

Disclosed herein is a secure package delivery container for receiving an article that does not require credentials to be input by the delivery person. The storage container comprises a container having a door secured by a user engageable locking device operable to be locked without credentials and upon input from the user. A lock activation device is operatively coupled to the user engageable locking device for receiving input from the user. A communications device is provided to communicate with an external device to report the state of the container, activation of the lock, and to receive instructions to lock or unlock the container. A sensing device is provided for identifying the presence of an object in the container. Additionally, sensors are provided to determine the location of container and the presence of delivery personnel. A user engageable opening device is provided to open or close the door when the user engageable locking device is in an unlocked state.

19 Claims, 13 Drawing Sheets

(56) References Cited

U.S. PATENT DOCUMENTS

| | | | | |
|---|---|---|---|---|
| 2018/0177319 | A1 | 6/2018 | Willis et al. | |
| 2018/0228311 | A1 | 8/2018 | Bloom et al. | |
| 2018/0296016 | A1 | 10/2018 | Teoh | |
| 2019/0038062 | A1* | 2/2019 | Sundaresan | E05B 73/0005 |
| 2019/0231106 | A1* | 8/2019 | Kaiserman | F25D 13/04 |
| 2020/0015616 | A1* | 1/2020 | Sankaran | B65D 5/3635 |
| 2020/0164886 | A1* | 5/2020 | Dutta | G06F 21/6236 |
| 2020/0397172 | A1* | 12/2020 | Kennett | A47G 29/141 |

* cited by examiner

SECURE PACKAGE DELIVERY CONTAINER AND METHOD

FIELD OF TECHNOLOGY

An improved secure package delivery container that does not require credentials to be input by a delivery person before inserting a package into the container or locking the container, and more particularly a secure package delivery container that allows remote engagement or disengagement of a locking mechanism.

BACKGROUND

With the proliferation of ecommerce, it has become increasingly desirable to provide a secure package delivery container to thwart the theft of articles left by delivery personnel on porches, next to garages, in driveways, etc. The art is replete with solutions to the burgeoning home delivery theft market. The state-of-the-art of proposed solutions creates yet another problem. With each unique container comes its own set of keys, codes, communications, wireless commands and the like to either access or lock the container. One can only imagine the number of keys, combinations, codes or tools a delivery person must carry with them to access all of the containers they may encounter on any given day. Then of course there is the issue with multiple deliveries. How can this be accommodated in an efficient and effective manner that secures the delivered package but does not increase the amount of time the delivery person must spend in the delivery process?

Additionally, there is a safety concern with automatic, or self-locking devices existing in prior art. Some prior art containers automatically lock upon closing without requiring the input of credentials by the delivery person. These containers pose a safety hazard if a child climbs into the container and the door is shut thus locking the child inside.

A further drawback existing in much of the prior art is the need to open the container to determine if a parcel has been inserted. Similar to checking the mail on a daily basis, many receptacle containers in the prior art require the user to open the container, often by unlocking, on a regular basis to check if a package has been delivered or not.

U.S. Pat. No. 6,412,688 to Tucker et al. ("Tucker") discloses a parcel receptacle having a housing and a door member coupled to the housing, the door member is structured to move between an open position and a closed position including a lock assembly. The parcel receptacle may be used as in integral part of an electronic delivery notification system operated by a delivery service provider. Once the parcel is placed in the parcel receptacle, the delivery service may enter data into the database indicative of a successful delivery. The database then notifies the customer of a successful delivery by a means such as a telephone message or email. This is accomplished "by utilizing an identification means such as numbers or codes [i.e. credentials], such as bar code, on each parcel receptacle and on the parcel" (column 6; lines 39-41). However, the parcel receptacle of the Tucker patent automatically locks when the lid is closed and does not solve the problem of requiring the input of credentials by the delivery person or the accepting of multiple deliveries.

U.S. Pat. No. 7,518,485 B2 to Shuster ("Shuster") discloses a method and apparatus for providing security for delivered goods purchased via electronic or telephonic commerce provided in the form of a digital lock box. A security box is comprised of a partitioned security door, a security door storage compartment, and a digital interface. The security box further includes extendable dowels to grant access to owners having an owner access code and a sensor array to limit shelf travel. A shelf continues to be lowered until contact is made between any part of sensor array and the delivered package. However, Schuster requires the use of unique access code (credentials) to open the container for inserting the parcel.

U.S. Pat. No. 7,743,935 to Maid ("Maid") discloses a self-locking enclosure including a mount to fix the container at a location. The enclosure provides a lid which locks upon a second occurrence of the lid being placed in a closed condition. When the lid of the Maid patent is opened, a first element extending from the lid is moved away from the latch element, allowing the latch to rotate into a position to slidably engage a second element extending from the lid to couple the lid to the latch. The Maid patent includes an enclosure mount to fix the container at a location or limit the travel. However, there is no way to open the device disclosed by Maid upon accidental locking. Nor is it possible to insert parcels on subsequent deliveries without having a key to unlock the container.

U.S. Pat. No. 9,630,757 to Capous ("Capous") discloses a self-locking delivery box comprising a rotating striker plate that remains in a closed position while the delivery box is empty but then rotates to an open position when a package or parcel is placed inside the delivery box. The Capous patent discloses a floating base plate that is forced downward when a package is placed inside, causing a rotating striker plate to unblock a window, allowing a spring-loaded latch to penetrate the striker plate window. Capous discloses another automatic locking box where there is no way to open the box upon accidental locking or to receive a second delivery.

United States Patent Application Publication No. 2001/0045449 by Shannon ("Shannon") discloses a storage device for use in temporarily storing delivered goods. The storage device provides a compartment with an access door associated with a locking device. The invention is also configured with a switch connected to a locking device for providing unlocking and locking of the locking device. An access code is provided to the commercial carrier (see FIG. 7 of Shannon) and stored into memory associated with the control unit, wherein the commercial carrier enters the provided access code into the input device and the access code is transmitted to the control unit to energize the switch. However, Shannon requires delivery personnel to provide credentials in the form of an access code.

United States Patent Application Publication No. 2011/0057774 by Van Rysselberghe ("Van Rysselberghe") discloses using a transaction-specific entry code for a lock that may be unlocked by entering the code for the purpose of delivering or picking up goods. A transaction-specific entry code may be communicated to a lock from a computer in conjunction with an ecommerce transaction. The lock device may be equipped with radio paging, cellular, or other radio receiver devices to facilitate communication between parties to a transaction, and to record data relating to delivery or pick-up of goods. However, Van Rysselberghe also requires credentials to access the lock.

United States Patent Application Publication No. 2015/0102903 by Wilkinson ("Wilkinson") discloses a secure-delivery receptacle that includes a delivered-package vault having a selectively-lockable access portal controlled, at least in part, by a control circuit coupled to a radio-frequency identification (RFID) tag reader. The control circuit selectively locks and unlocks a locking mechanism.

The control circuit verifies a pre-authorized delivery-vector RFID tag and responsively unlocks the locking mechanism. The control circuit can verify when at least one expected package RFID tag is placed within the delivered-package vault to confirm delivery of the corresponding expected package, by, for example, sending one or more messages to the intended recipient, the delivery service, and the shipping party. Again, Wilkinson requires the use of credentials in the form of an RFID tag.

United States Patent Application Publication No. 2016/0066733 by Gozar ("Gozar") discloses a lock box comprising a door providing access to a storage space, an electrically operated locking mechanism, and an optical or laser reader parcel scanning device. The system also provides a memory configured to store computer-readable code executable by a processor. The code comprises instructions for decoding a parcel tracking number scanned by the scanning device and determining if the tracking number is an authorized tracking number. If the tracking number is not an authorized tracking number, the door remains locked. If the tracking number is an authorized tracking number, the locking mechanism is enabled to unlock the door, whereby the door is allowed to be opened and the parcel placed into the storage space. After the door has been closed, the locking mechanism is enabled to lock the door. The code also comprises instructions to send messages to the recipient of the parcel. A communications port is provided to communicate with other electronic devices, such as a computer, server or mobile device. A mechanical attaching means is attached to the lock box for the purposes of rigidly affixing the lock box to a structure, such as an accessible exterior wall of a home or other building. However, Gozar also requires credentials in the form of a tracking number to access the container.

United States Patent Application Publication No. 2018/0177319 by Willis et al. ("Willis") discloses a secure lock box with near proximity awareness, including a lock box housing defining at least one enclosable space for the receipt of a package, each enclosable space accessible through an aperture sealable by a door at least partially attached to the lock box housing. An electronic lock is provided for engaging the door with the lock box housing to enclose the space. A processor, a near proximity device structured and arranged to actively detect at least one package attribute from a package proximate to the lock box, a network component coupled to the processor and a non-volatile memory coupled to the processor having executable instructions to direct the operations of the near proximity device and the electronic lock. At least one defined characteristic is provided to the secure the lock box for operation. Examples of a defined characteristic and package attribute include a tracking number, an order ID, a graphic, bar code, QR code, numeric sequence, alphanumeric sequence, tonal pattern, date, time, hash value, or other data element. Again, Willis et al. requires credentials in the form of a "defined characteristic" in order to operate the box.

United States Patent Application Publication No. 2018/0228311 by Bloom et al. ("Bloom") discloses a package securement device for receiving packages. The device has an opening allowing for removal and insertion of packages, a credential receiver for providing access to the containment device through an electronic device configured to receive a credential input by a user. A communication module with a wireless transmitter is connected to the electronic device to transmit and receive wireless communication regarding the status of the package securement device. A remote user interface may be used to monitor and control access to the containment device. The electronic device may be equipped with a wireless communication device to receive the access code and compare the presented access code to a list of predetermined authorized codes. Alternatively, the user receiving the packages may validate the access code in real time through a remote device such as a smart phone. Access codes may be entered through a user interface on a touch panel on the smart box or on the door lock or the user interface may use a camera and a microphone to enable audio and video communication between the common carrier and the package receiver. Bloom suffers the same challenges as its predecessors in that an access code is also required.

United States Patent Application Publication No. 2018/0296016 by Teoh ("Teoh") discloses a collapsible secured parcel drop box that includes a lid that shuts over an inner space defined by panels. A lock assembly allows opening of the lid and subsequent locking to secure the lid over the space defined by the panels. The lock assembly is left in an unlocked position until a delivery person inserts a package. Once a delivery person inserts a package into the drop box assembly, the delivery person will move the tab on the outer portion of the lid to the locked position. A bracket is provided to temporarily secure the parcel drop box to a fixed structure. However, there is no way to unlock the device disclosed by Teoh upon an accidental locking or to receive an additional package.

U.S. Pat. No. 9,327,887 to Farentinos et al. ("Farentinos") discloses a receptacle for receiving objects including a single-delivery mode that does not require an access code. The lid automatically locks after the delivery. A multi-delivery mode requires the entry of a security code into a code-operated device to unlock the lid, open the lid, place the delivery into the receptacle, and close the lid which automatically locks when closed. This invention does not have any communication from the lock to the user. With multiple deliveries, the delivery person must enter a code to re-open the box after it has been initially locked. Additionally, there is the safety issue of the automatically locking cover. Also, there is no communication to the recipient of a parcel in the container requiring the user to continually unlock and open the container to check if there is a parcel present in the container.

U.S. Pat. No. 10,039,401 by Romanucci ("Romanucci") discloses a container including a mobile communication device including an App designed to control locking/unlocking of an associate locking mechanism, and an electronically controlled locking mechanism affixed to the container and lid, the electronically controlled locking mechanism being associated with the mobile communication device so as to be locked/unlocked in response to the operation of the mobile communication device. However, this invention requires the syncing of the lock with at least one parcel delivery service mobile communication device to allow remote control of the locking/unlocking of the associated locking mechanism through the mobile communication device of the delivery service. The delivery person or service is required to enter its electronic credentials in order to open the container.

U.S. Pat. No. 9,004,346 by Farentinos et al. ("Farentinos") discloses a container utilizing a rotatable drum opening where multiple parcels can be put into the container without the delivery person entering any credentials and the parcels are removed by the user from a locked section located at the bottom of the container. This invention lacks any communication from the container to the users and suffers the same shortcoming where the user is required to repeatedly unlock and open the container to determine if a parcel has been inserted into the container.

There is also prior art that has a mechanical push lock that locks the box on the initial delivery, so the delivery person does not need to enter any credentials. However, the lock on this container is mechanical and has to be unlocked with a key before any subsequent deliveries can be made creating the problem of multiple deliveries. Also, the user is required to repeatedly unlock and open the container to determine if a parcel has been inserted into the container.

Therefore, there is a need in the art for a secure package delivery container operable to be locked without credentials and upon input from the user and further capable of receiving additional deliveries without requiring any credentials being input by the delivery person; and further capable of communication to the user of the receipt of a package and status of the locking mechanism.

SUMMARY

A secure package delivery container comprises a container defining a storage volume where the container has a container body formed of at least one wall and a bottom. The container has a door operably attached to the container body where the door is adapted to be moved from an open position to a closed position. The container may have a slot for receiving packages. A user engageable locking device secures the door to the container body in the closed position. The user engageable locking device is operable to be locked without credentials and upon an input from a user. A lock activation device is operatively coupled to the user engageable locking device. The lock activation device receives input from a user and commands the user engageable locking device to be in a locked or unlocked state. The lock activation device is further operable to allow opening or closing the door when the lock is an unlocked state. The lock activation device may be integrated into the user engageable locking device.

A user engageable opening device is operable to open or close the door when the lock is an unlocked state. The user engageable opening device may be a switch. The user engageable opening device may be an actuating member connected to a wireless device.

The secure package delivery container further comprises a communications device in communication with the lock activation device adapted to send signals to and receive signals from the lock activation device. The communications device is adapted to send signals to and receive signals from an external device. The communications device is in communication with the user engageable locking device to command the user engageable locking device to be in a locked state. The communications device is in communication with a lock activation device to command the user engageable locking device to be in an unlocked state. The secure package delivery container may further comprise an external communications device such as a camera, microphone and motion detector. The communications device may further be adapted to communicate the state of the container.

The secure package delivery container may further comprise a device for identifying the presence of an object in the container. The device for identifying the presence of an object in the container is selected from the group consisting of a light source, photodetector, IR LED and IR detector, CMOS sensor, proximity sensor, camera and microphone or any other detection method known in the art or hereinafter developed. A communications device may be operatively coupled to a GPS sensor for determining the location of the container. Further a magnetometer, gyroscope and accelerometer may aid in determining the location of the container.

The secure package delivery container may further comprise a climate control system. The climate control system may be a refrigeration system or heating system. The container may be insulated. A vent may be disposed in a wall of the container. The container may be collapsible by comprising a plurality of sides where at least two sides are joined by a hinge. The container may include hardware for securing the container in a location. In addition, the container may comprise a chute for receiving a package.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description. Exemplary illustrations are described in detail by referring to the drawings as follows:

DETAILED DESCRIPTION

Exemplary illustrations of secure package delivery container are shown in the attached drawings. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

As used herein, the phrase "state of the container" refers to any characteristic of the container, including, but not limited to, whether the container is locked or unlocked, the presence of an object in the storage volume of the container, whether an object is moving within the container, the air temperature of the storage volume, the location of the container, the direction the container is traveling, the velocity of the container, whether the container is receiving power, whether the container is being heated, whether the container is being cooled or indicia of the contents of the container.

Figure 1:
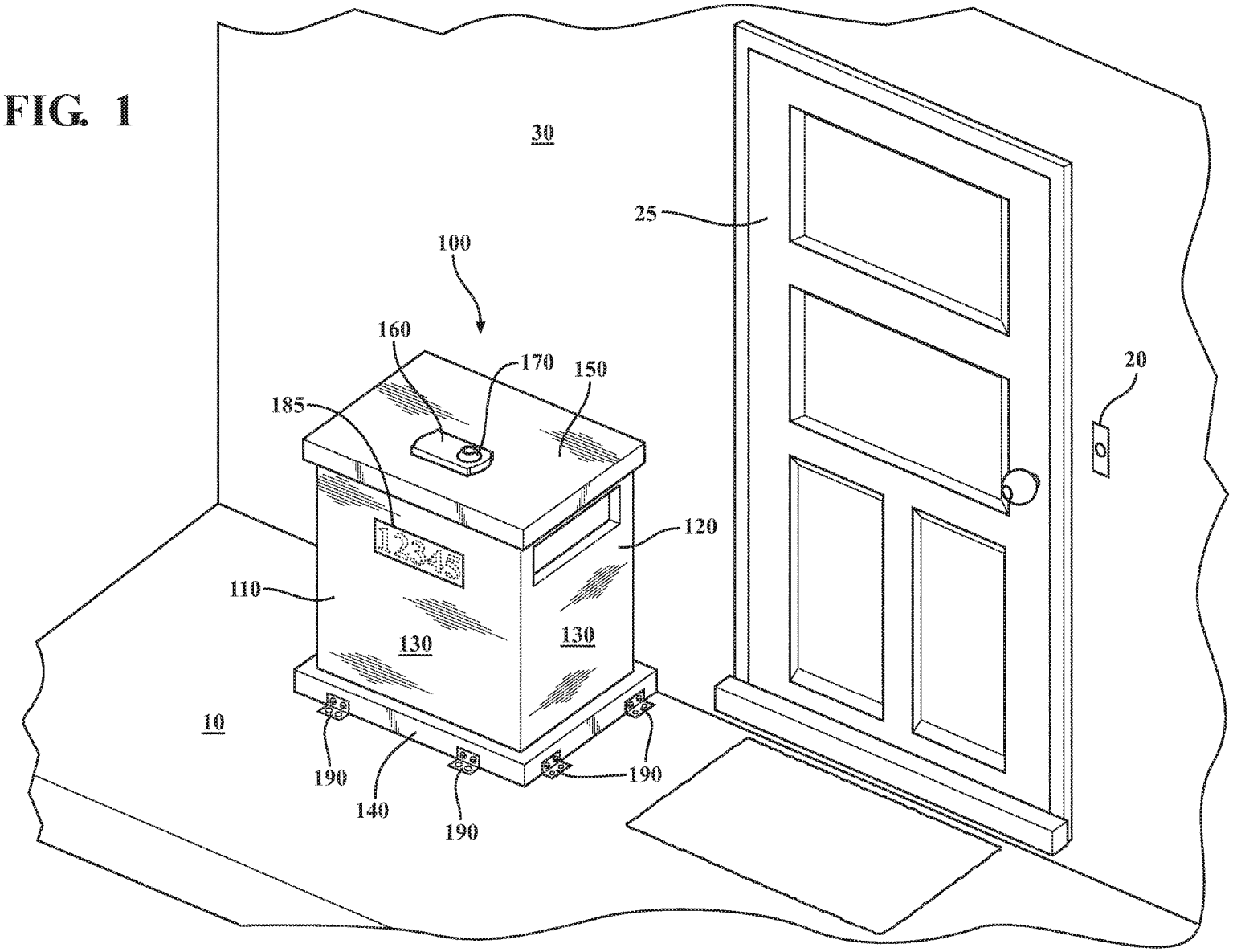
FIG. 1 is an environmental view of an embodiment of a secure package delivery container.

With initial reference to FIG. 1, an embodiment of a secure package delivery container 100 is shown located on a porch 10 of a structure with a doorbell 20 mounted on a wall 30 by a door 25. The secure package delivery container 100 comprises a container 110 having a container body 120 formed of at least one wall 130 and a bottom 140. The secure package delivery container 100 has a door 150 adapted to be moved from an open position to closed position.

A user engageable locking device 160 secures the door 150 to the container body 120 in a closed position. The user engageable locking device 160 is operable to be locked without credentials and upon an input from a user. As used herein "credentials" shall refer to any means used to identify a user including, but not limited to, a barcode, an RFID tag, a numerical code, an alphanumerical code, a key, a combination, a wireless input, or a user identification. A lock activation device 170 is operably coupled to the user engageable locking device 160. The lock activation device 170 is provided for receiving input from a user and commanding the user engageable locking device 160 to be in a locked or unlocked state. The lock activation device 170 may be integrated with the user engageable locking device 160, mounted on the container 110 or door 150, or located remotely, for example, integrated with the doorbell 20 or otherwise remotely located as described further herein. In an embodiment, the lock activation device 170 is a suitable switch such as a button.

Upon successfully placing a package into the container 100 and closing door 150 the user may press the button/lock activation device 170 to lock the container 100. Upon pressing the lock activation device 170 communications may be sent to notify the recipient of the successful delivery, as is described more fully below.

Figure 2:
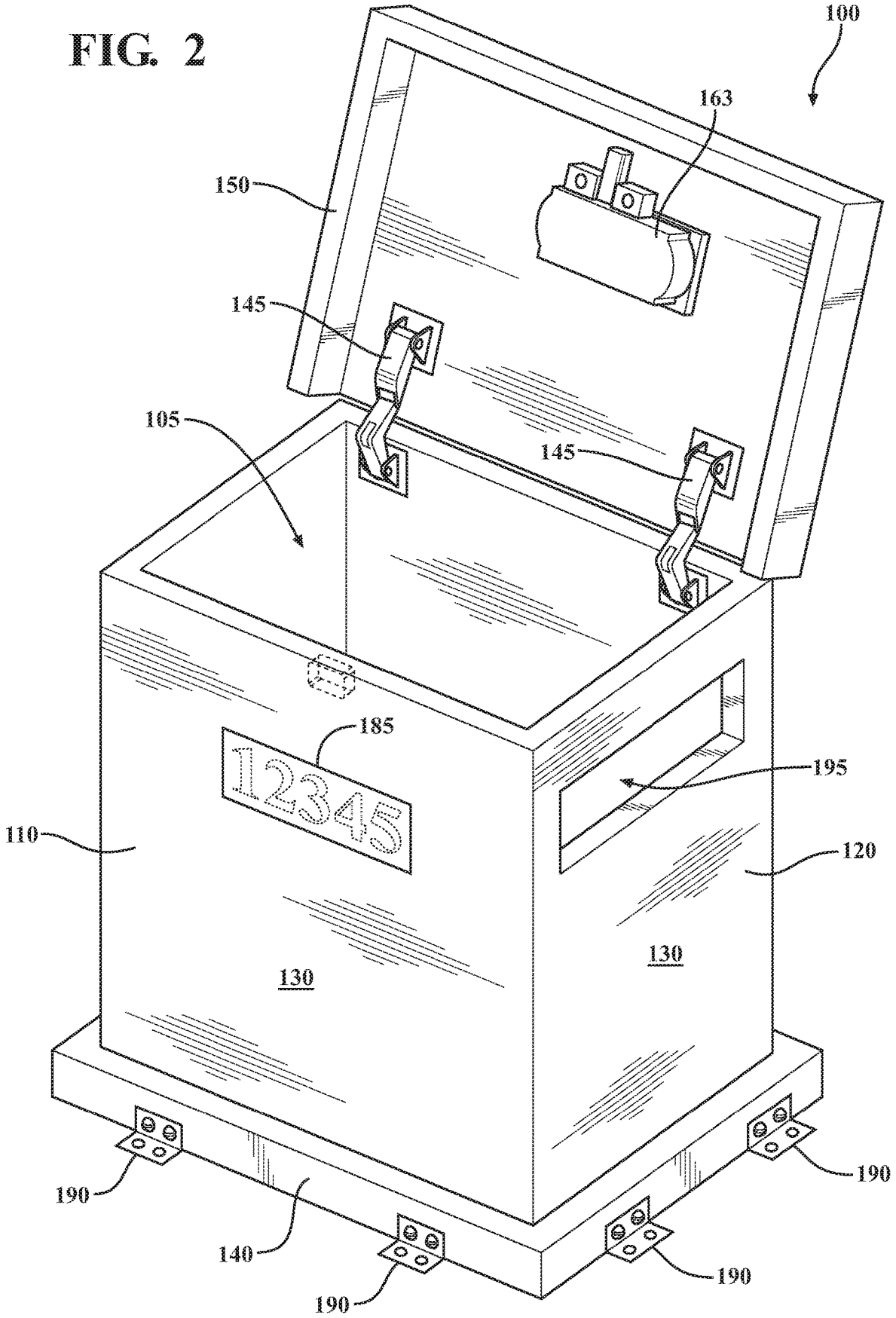
FIG. 2 is a perspective view of a secure package delivery container with the door in an open position.

Referring also to FIG. 2, the secure package delivery container with the door 150 in an open position is shown, revealing a storage volume 105. In the immediate embodiment, the door 150 is operatively attached to the container body 120 by a pair of hinges 145. A locking mechanism 163 associated with the user engageable locking device 160 is shown securely attached to the door 150 and positioned to permit the door 150 to be locked in a closed position. Although the container body 120 is disclosed in a rectangular shape in the present embodiment, any suitable shape is contemplated, including a cylindrical body, a hexagonal body, a square body, etc. Likewise, any suitable number of walls 130 may be provided to be within the spirit and scope of the present mention. The container 110 may be formed of wood, plastic, metal, stone, and any composite material known in the art or hereinafter developed. A track 185 is shown to attach identification means such as a recipient's name or address number. Hardware 190 is shown attached to the bottom 140 for securing the container 100 in a location.

Figure 3:
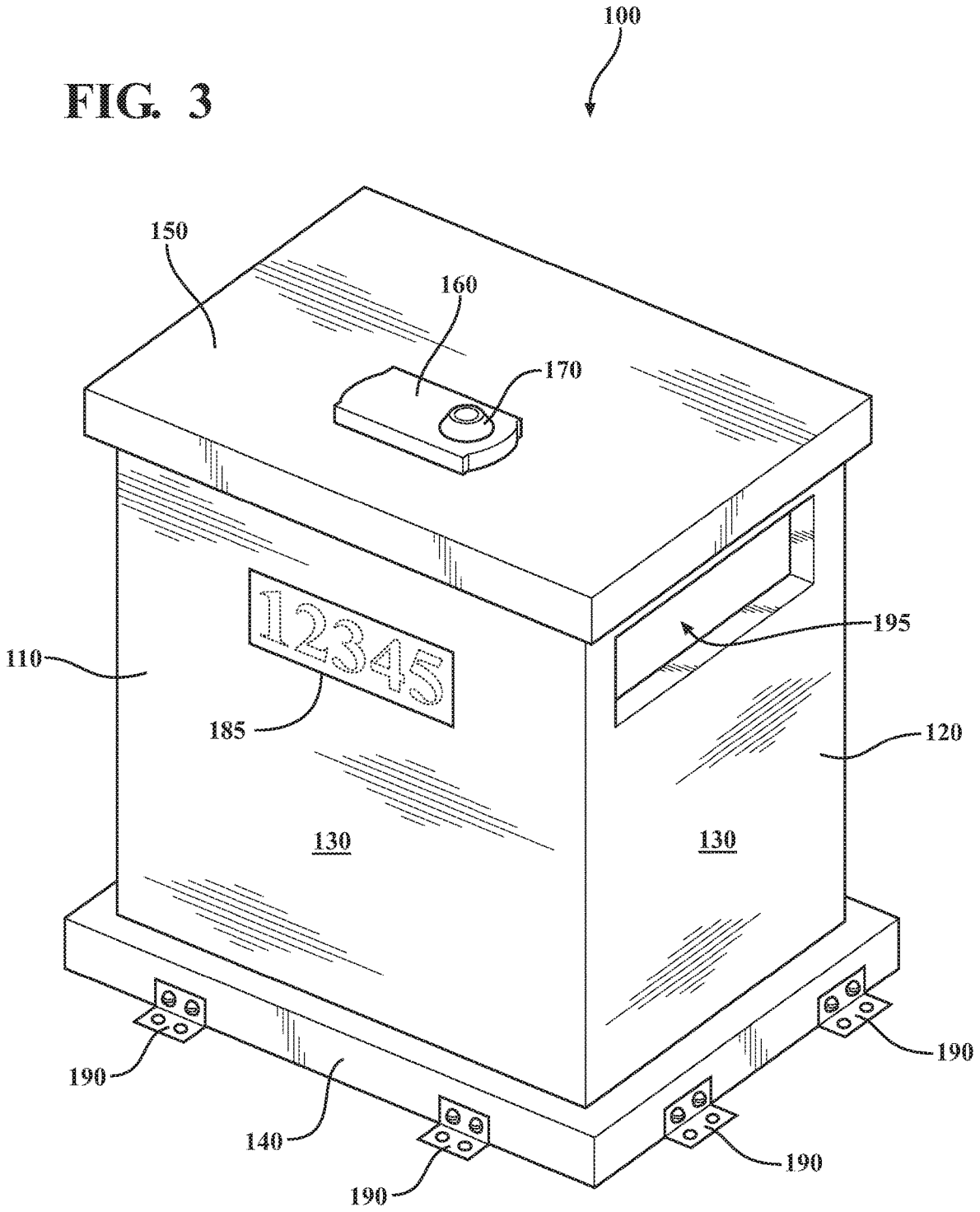
FIG. 3 is a perspective view of a secure package delivery container with the door in a closed position.

Referring now also to FIG. 3, in a non-limiting embodiment the secure package delivery container 100 is shown with the door 150 in a closed position. In the present embodiment, the container body 120 includes a chute 195 located within a wall 130. Preferably, the chute is of a size adequate to accept a range of package sizes but will not allow for reaching into the container to retrieve any packages. It is expressly intended that the secure package delivery container 100 may not have a chute.

Figure 4:
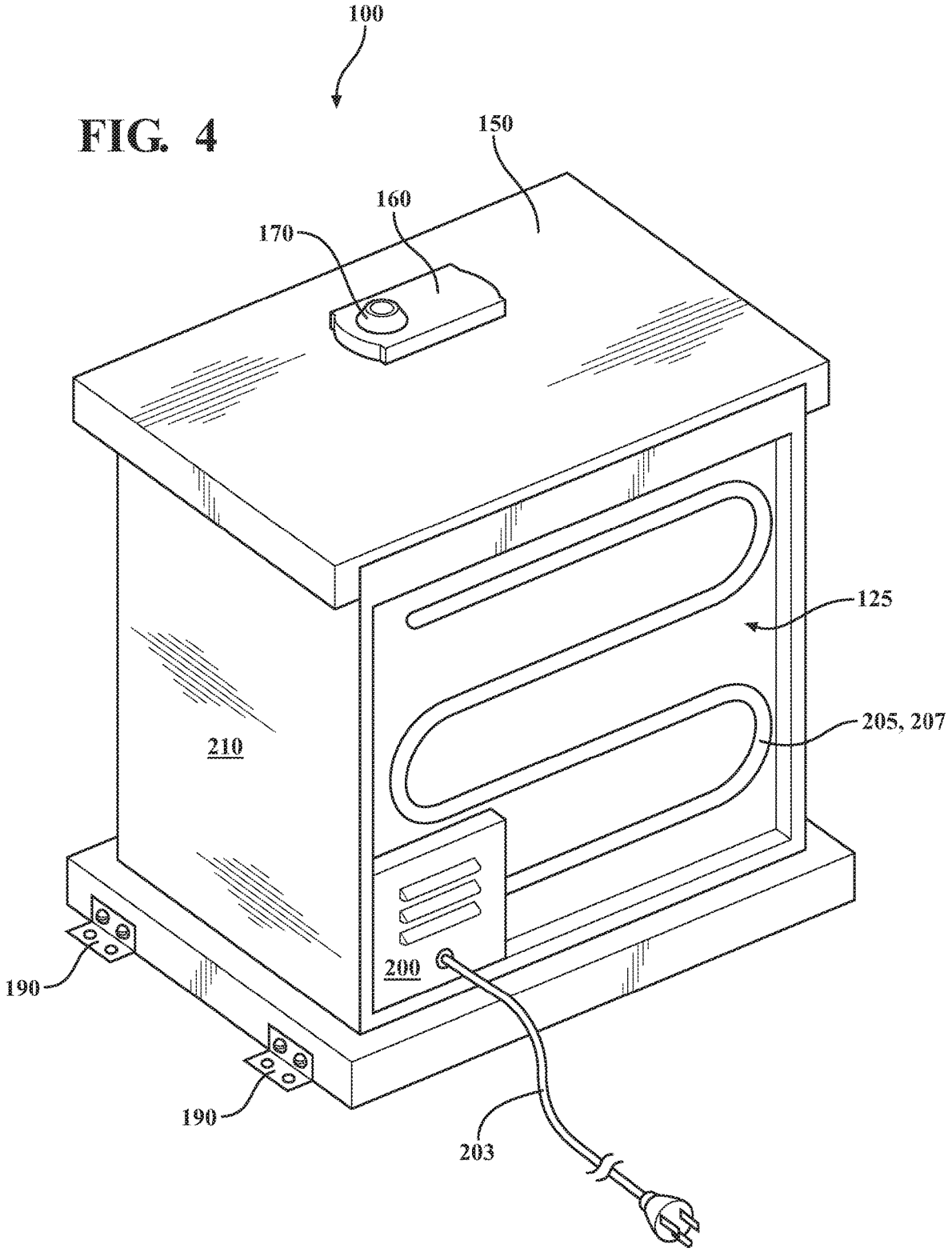
FIG. 4 is a perspective view of a secure package delivery container with a climate control system.

Referring now also to FIG. 4, in a non-limiting embodiment, the secure package delivery container 100 is shown having a climate control system 200 located on the back side 125. The climate control system 200 may be a refrigeration system 205 or heating system 207. Power is provided to the refrigeration system 205 or heating system 207 by power cord 203. Additionally, insulated walls 210 may be provided to improve the efficiency of the climate control system 200. In the present embodiment electrical power is provided by an electric power cord 203, however other means may be provided to power the container 100 such as batteries, solar power, or wind power. It is contemplated that any necessary power conditioning circuitry is contained within the secure package delivery container 100.

Figure 5:
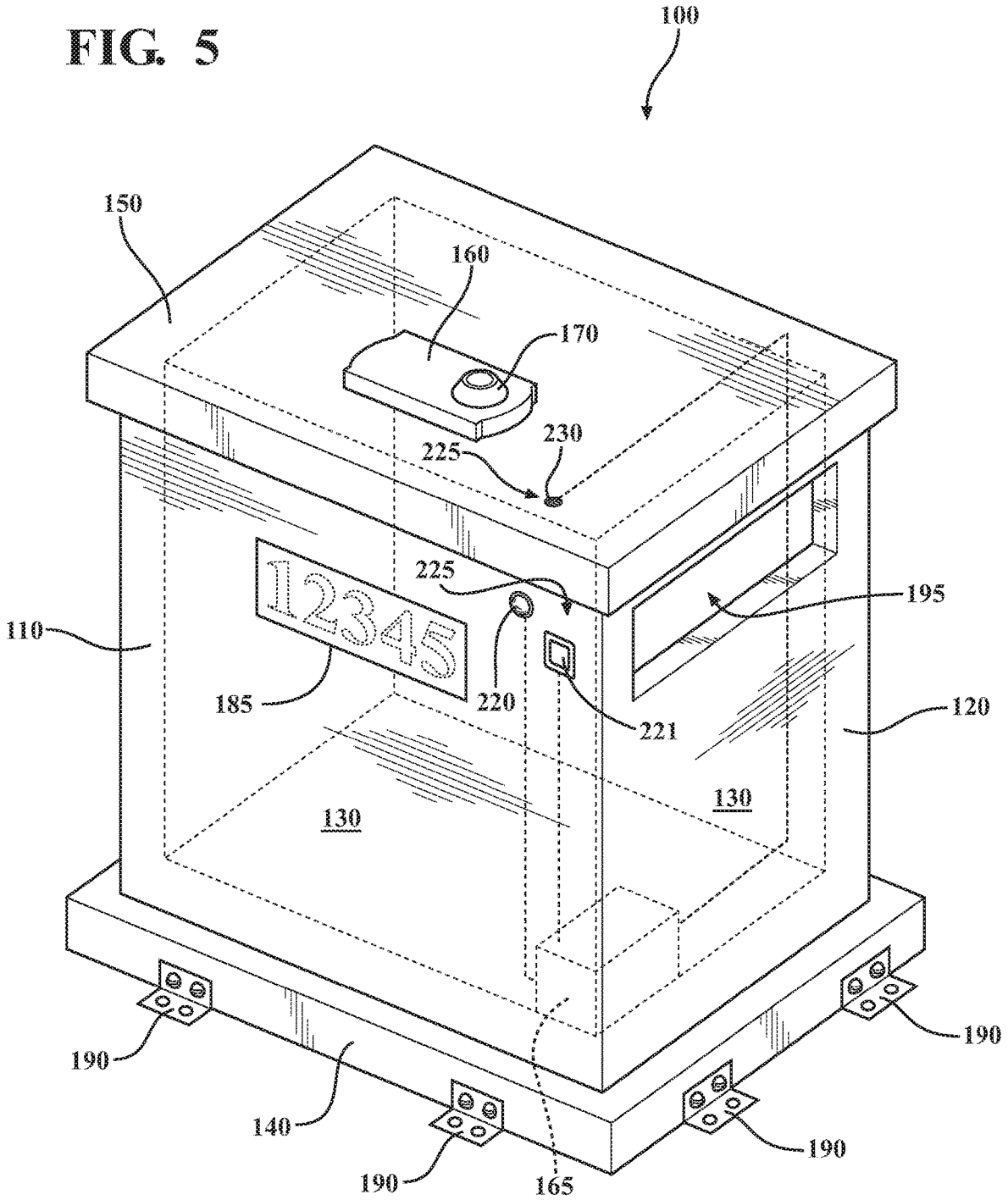
FIG. 5 is a perspective view of a secure package delivery container with a microphone, camera and motion detector.

Referring now also to FIG. 5, in a non-limiting embodiment the secure package delivery container 100 is shown having an external communications device 225 on the outside of the container 100. Examples of an external communications device 225 include a microphone 230 and camera 220 for providing communications between a user and delivery person or other person in proximity to the container 100. The external communications device 225 may also include a motion detector 221. The external communications device 225 is capable of sensing the presence of a person such as a delivery person approaching the container 100. Communications are enabled through the communications device 165 described further below. Communications systems may be adapted from existing systems such as the system disclosed in U.S. Pat. No. 9,819,867 titled, Low-Power-Consumption Audio/Video Recording and Communication Doorbell. Other communications systems known to those skilled in the art may also be used.

Figure 6:
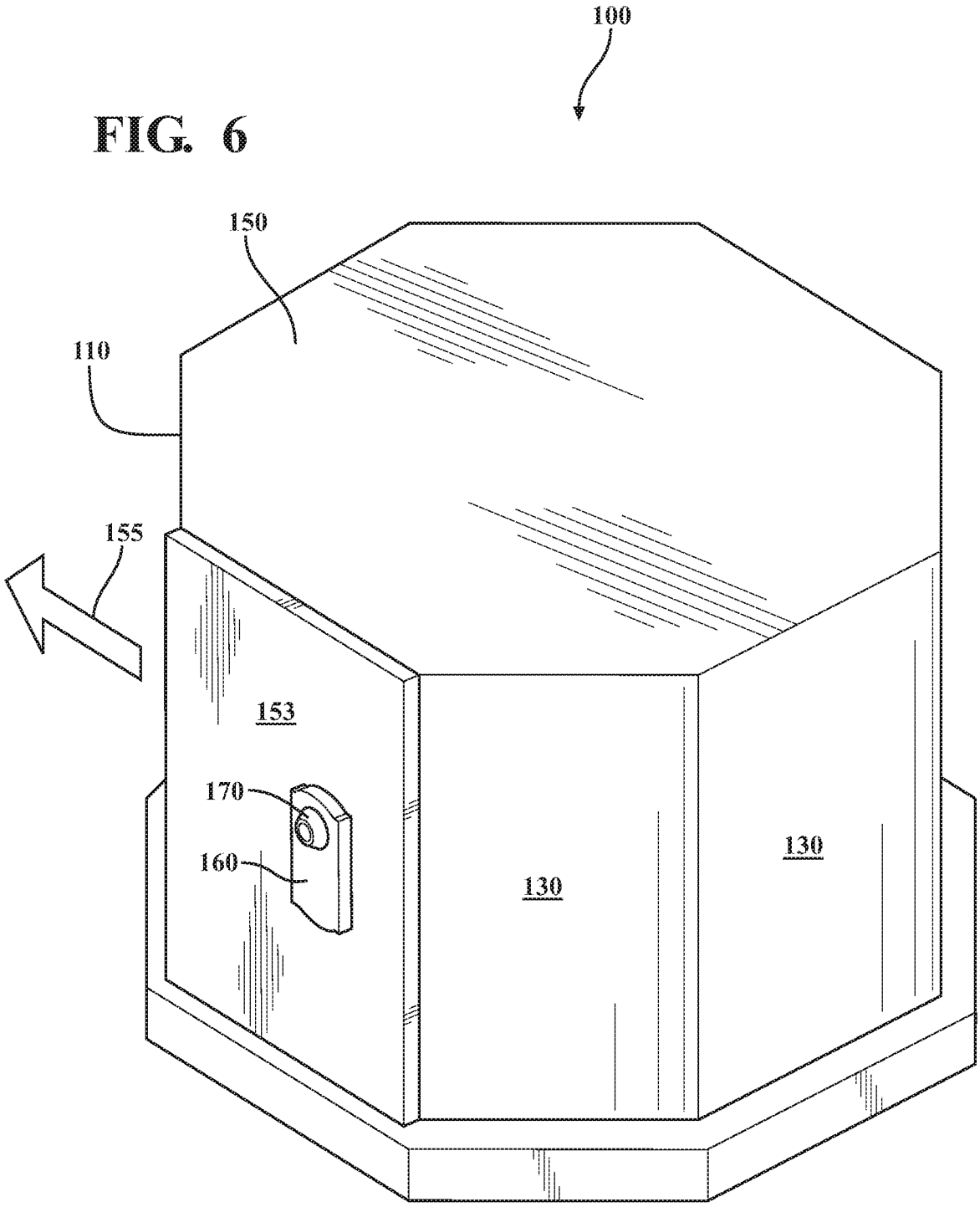
FIG. 6 is a perspective view of a secure package delivery container having a hexagonal body and a sliding door.

Referring now also to FIG. 6, in a non-limiting embodiment, the secure package delivery container 100 is shown having an octagonal body 110 and a sliding door 153 movable in an opening direction 155. The door 153 may be actuated by any means known to those skilled in the art, including but not limited to, a slider crank, a rack and pinion, ballscrews, servo motors, and the like. The container 100 may further include a drain (not shown) at the bottom.

Figure 7:
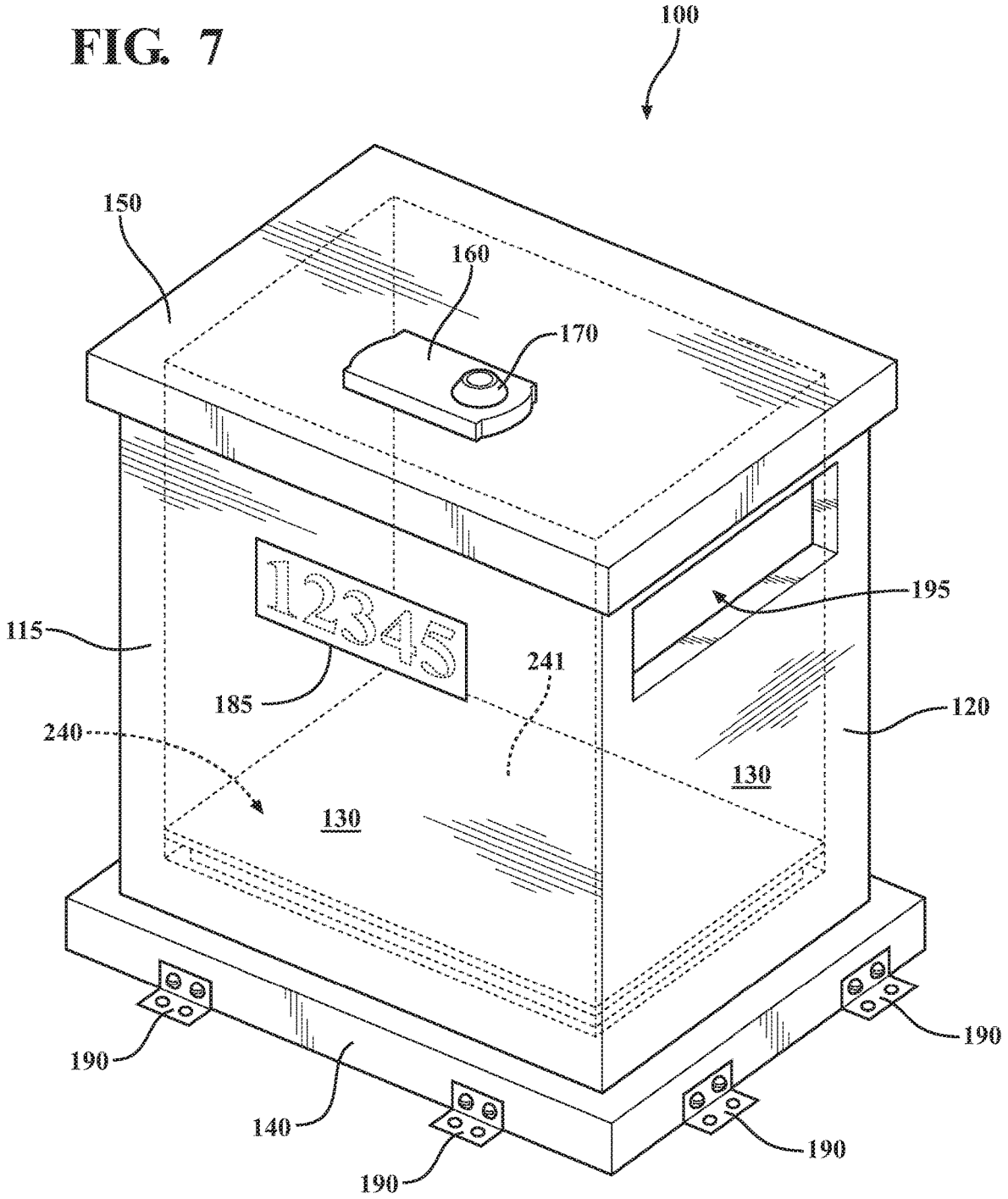
FIG. 7 is a perspective view of a secure package delivery container with a parcel sensing device.

Referring now also to FIG. 7, in a non-limiting embodiment the secure package delivery container 100 is shown with a parcel sensing device 240 for identifying the presence of an object in the container 100. In the present embodiment the parcel sensing device 240 is a load cell 241 which would determine the state of the container by identifying the presence of the object by its mass, similar to that of a bathroom scale. Information regarding the state of the container may be communicated to the recipient by the communications device described further below.

Figure 8:
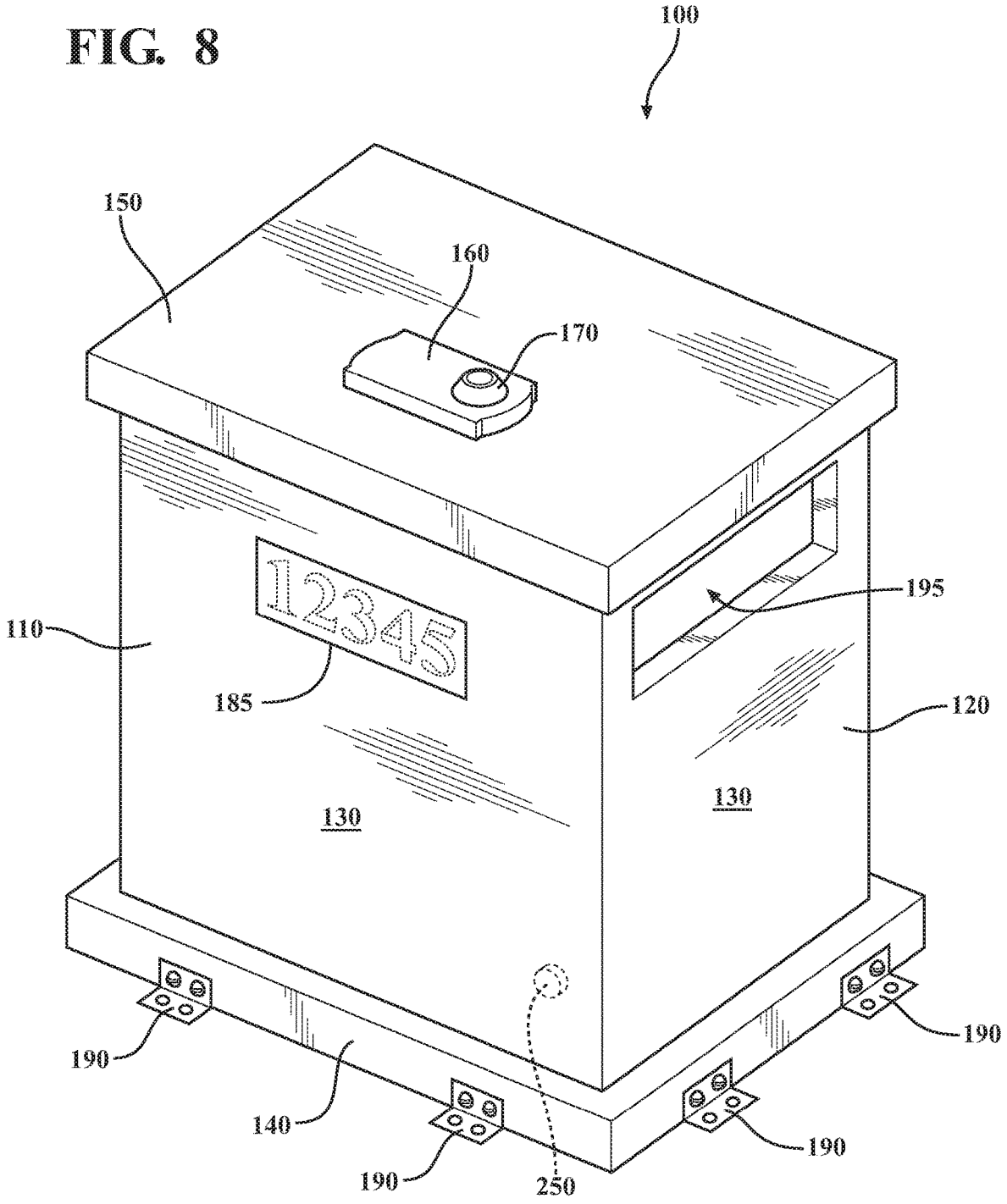
FIG. 8 is a perspective view of a secure package delivery container with a location sensing device.

Referring now also to FIG. 8, in a non-limiting embodiment the secure package delivery container 100 is shown with a location sensing device 250. A GPS chip (not shown) provides the actual location of the container 100 within a range of approximately 5 meters by communicating with satellites and transmitting the data to an external device (not shown) using wireless connectivity. Examples of such a chip include the Nano Hornet GPS module having an integrated patch antenna. Another example is the BCM47755 chip by Broadcom capable of communicating with L1 and L5 satellites. The location sensing device 250 may also comprise at least one of a magnetometer, gyroscope or accelerometer for determining the location, or movement, of the container 100. A magnetometer senses magnetic fields and can provide a heading relative to the Earth's magnetic North Pole. A gyroscope provides orientation details about the container 100. The accelerometer detects how fast the container 100 is traveling at any given time.

Figure 9:
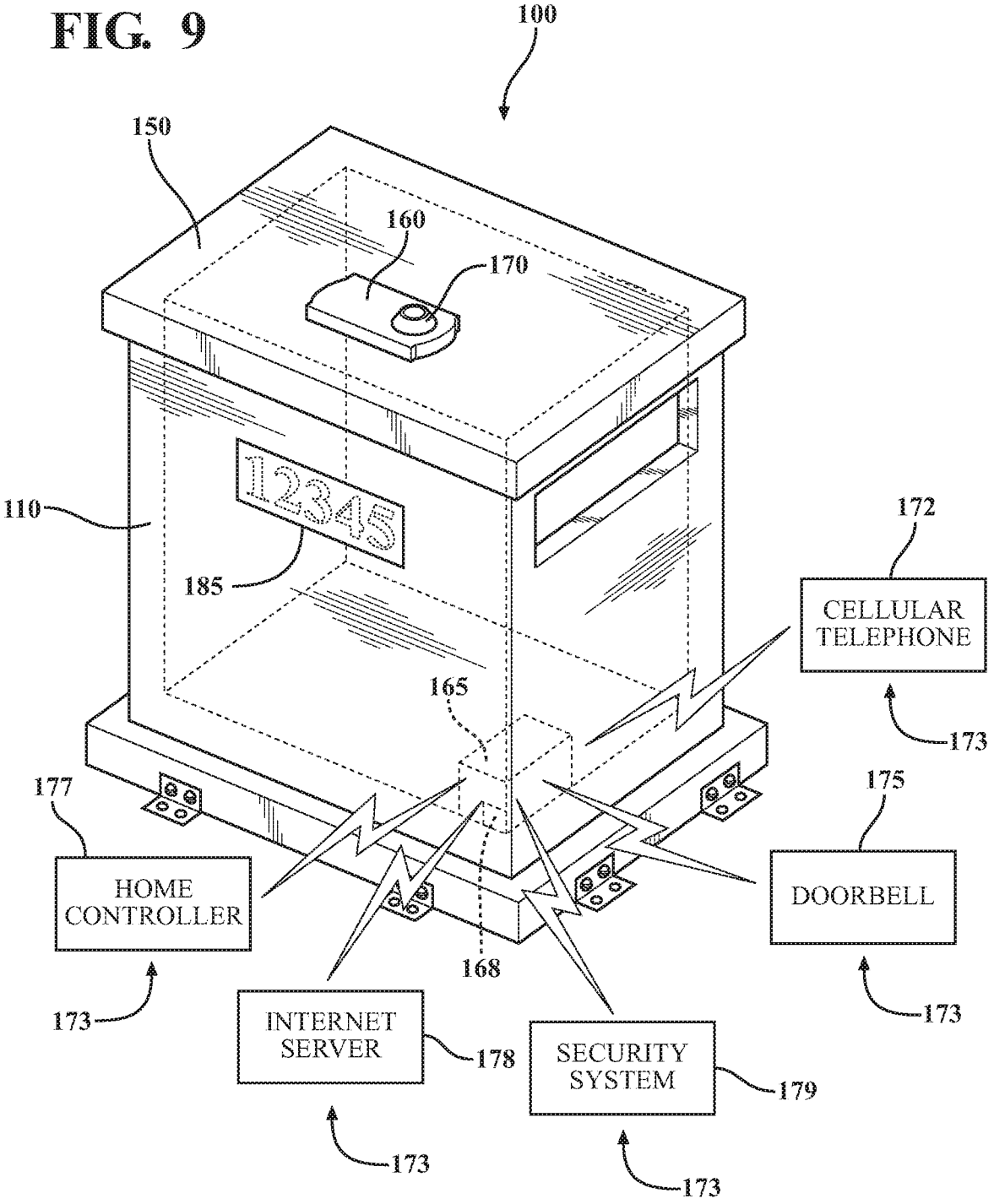
FIG. 9 is a perspective view of a secure package delivery container with wireless communications.

Referring now also to FIG. 9, in a non-limiting embodiment the secure package delivery container 100 is shown having a wireless communications device 165. The wireless communications device 165 is in communication with the lock activation device 170 to transmit signals to and receive signals from the lock activation device 170. A processor 168 is provided to retrieve instructions and execute arithmetic logic units. Nonvolatile memory (not shown) may be provided to store instructions. Alternatively, a microcontroller may be substituted for processor 168. The processor 168 and microcontroller are known to those skilled in the art.

The wireless communications device 165 is also in communication with the user engageable locking device 160 to command the user engageable locking device 160 to be in a locked state. Further, the communications device 165 may provide instructions to command the user engageable locking device 160 to be in an unlocked state. The communications device 165 may notify the recipient of delivery of a package and accordingly may institute instructions to unlock the container 100 so that an additional package may be deposited therein. Therefore, a recipient may remotely unlock the container 100 prior to delivery of a second, third or subsequent parcel. Alternatively, the user and delivery person or other person in proximity to the container 100 may communicate through the external communications device 225 (as described in reference to FIG. 5). The communications device 165 may transmit signals to or receive signals from an external device 173, including, but not limited to: a cellular telephone 172, a doorbell 175, a security system 179, a home controller 177 or an Internet server 178. The external device 173 may be any device known in the art or developed in the future capable of transmitting signals to or receive signals from the communications device 165. The communications device 165 may be integrated with the user engageable locking device 160 to transmit signals therefrom. Although the operation of a transmitter has been disclosed, the invention also contemplates the addition of a receiver, or a transceiver in place of a transmitter and receiver. It should be understood that any means known in the art, or developed in the future, for communicating wireless signals is intended to be within the spirit and scope of the present embodiment. It should be understood that a number of frequency bands may be operationally enabled in the present embodiment to communicate with various devices, for example 850 MHz, 1900 MHz and 1700 MHz to communicate with cellular phones 2.4 GHz and/or 5 GHz to communicate with a Wi-Fi router, 3.5 GHz to communicate with satellite and 2400 MHz to communicate with Bluetooth.

Accordingly, the communications device 165 is capable of sending signals to and receiving signals from any wireless devices known in the art. Furthermore, it should be understood that the secure package delivery container 100 of the present invention may be hard wired, such as by a LAN, WAN or Ethernet cabling using any suitable protocol known to those skilled in the art. The communications device 165 may communicate the state of container to any external device 173.

The communications device 165, including any external device 173, is operable to remotely instruct the opening of the door 150 of the container 100 when the user engageable locking device 160 is in an unlocked state. The opening mechanism (not shown), as known to those skilled in the art, is activated by the communications device 165 to open or close the door 150. This capability allows for remotely instructing the opening of the door 150 thus allowing a delivery into the container 100 by a delivery person without requiring the delivery person to open the door. Similarly, the door 150 may be closed in the same manner thus allowing the delivery person to leave a delivery without opening or closing the door 150.

Figure 10:
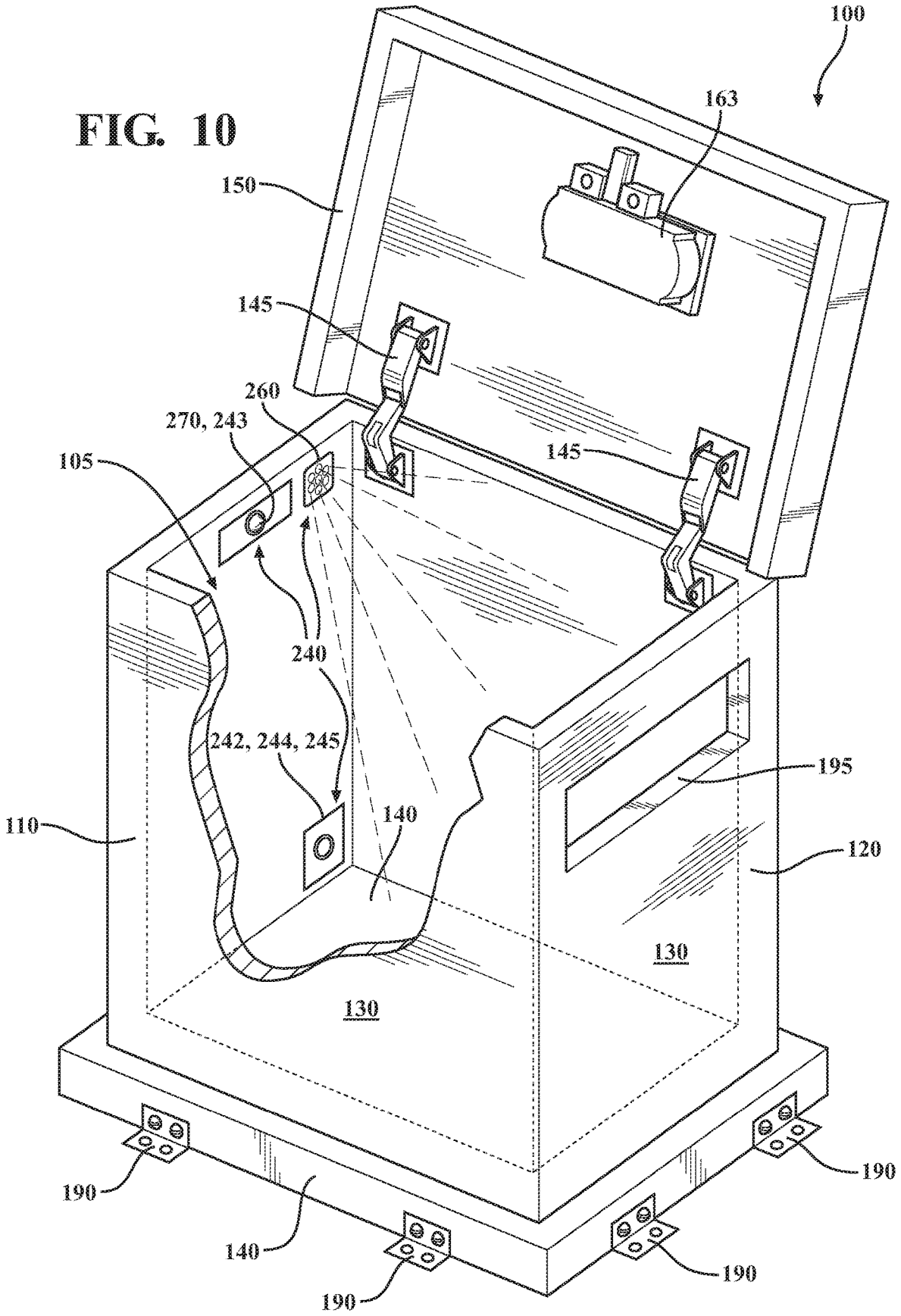
FIG. 10 is a perspective view of a secure package delivery container with object sensing.

Referring now also to FIG. 10, in a non-limiting embodiment the secure package delivery container 100 is shown with alternative object sensing devices 240. A load cell 241, proximity sensor 242, IR LED 244 and IR detector 245, or other light source photodetector (not shown) may be used to detect the presence of an object in the container. Signals indicative of the state of the container from the object sensing devices 240 may be communicated wirelessly or by cable to an external device 173. Alternatively, a lowlight CMOS 243 may be used to identify the presence of an object in the container 100. Likewise, a light 260 and video camera 270 may be employed to identify the presence of an object in the container 100 and the signals from the camera may be communicated to an external device 173 by way of the communications device 165.

Figure 11:
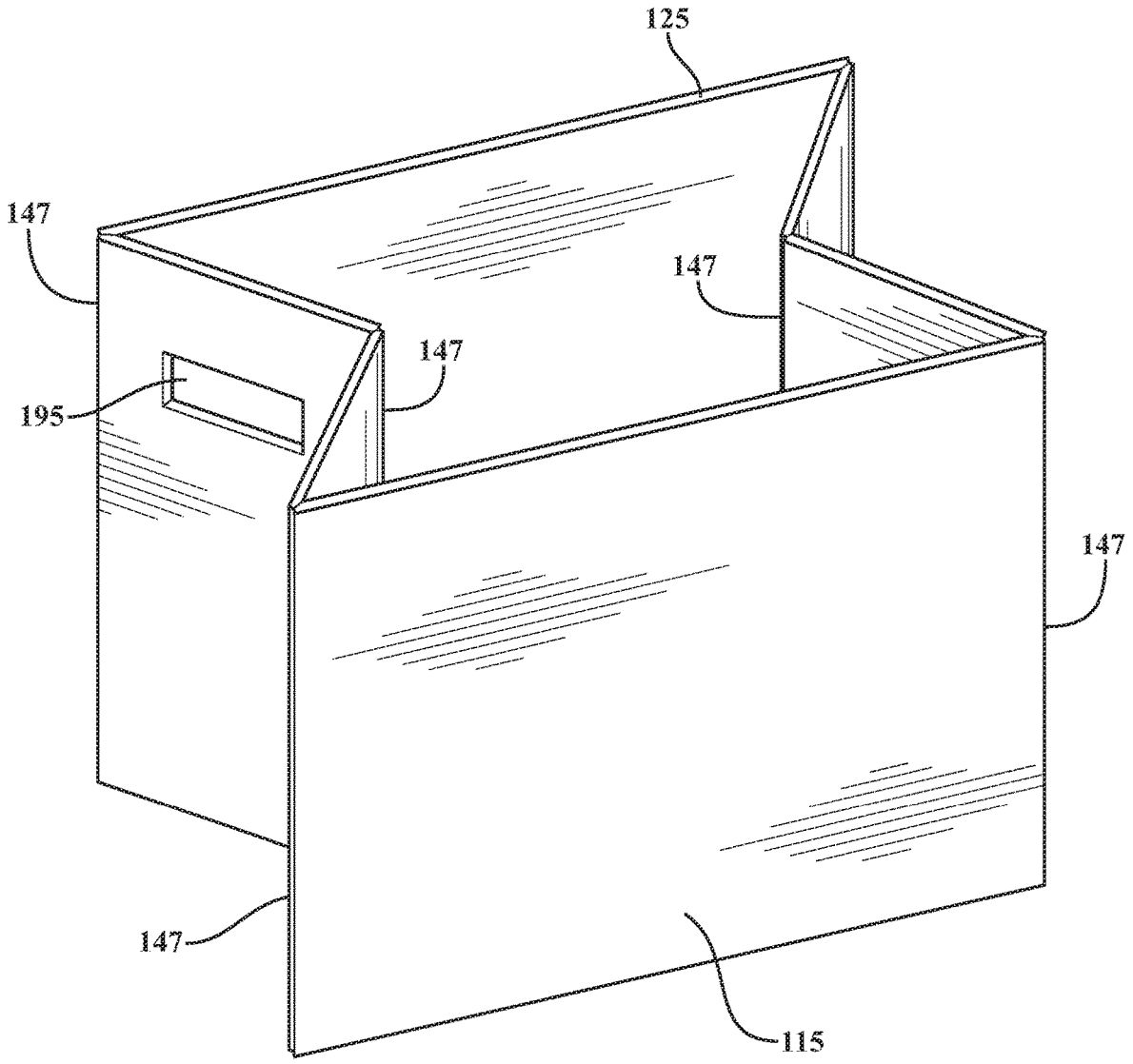
FIG. 11 is a perspective view of a collapsible secure package delivery container.

Referring now also to FIG. 11, in a non-limiting embodiment, a collapsible secure package delivery container 100 is shown having a back wall 125, the front wall 115 and a plurality of hinges 147. The container 100 of the immediate embodiment may be assembled by any suitable means known in the art including threaded fasteners.

Figure 12:
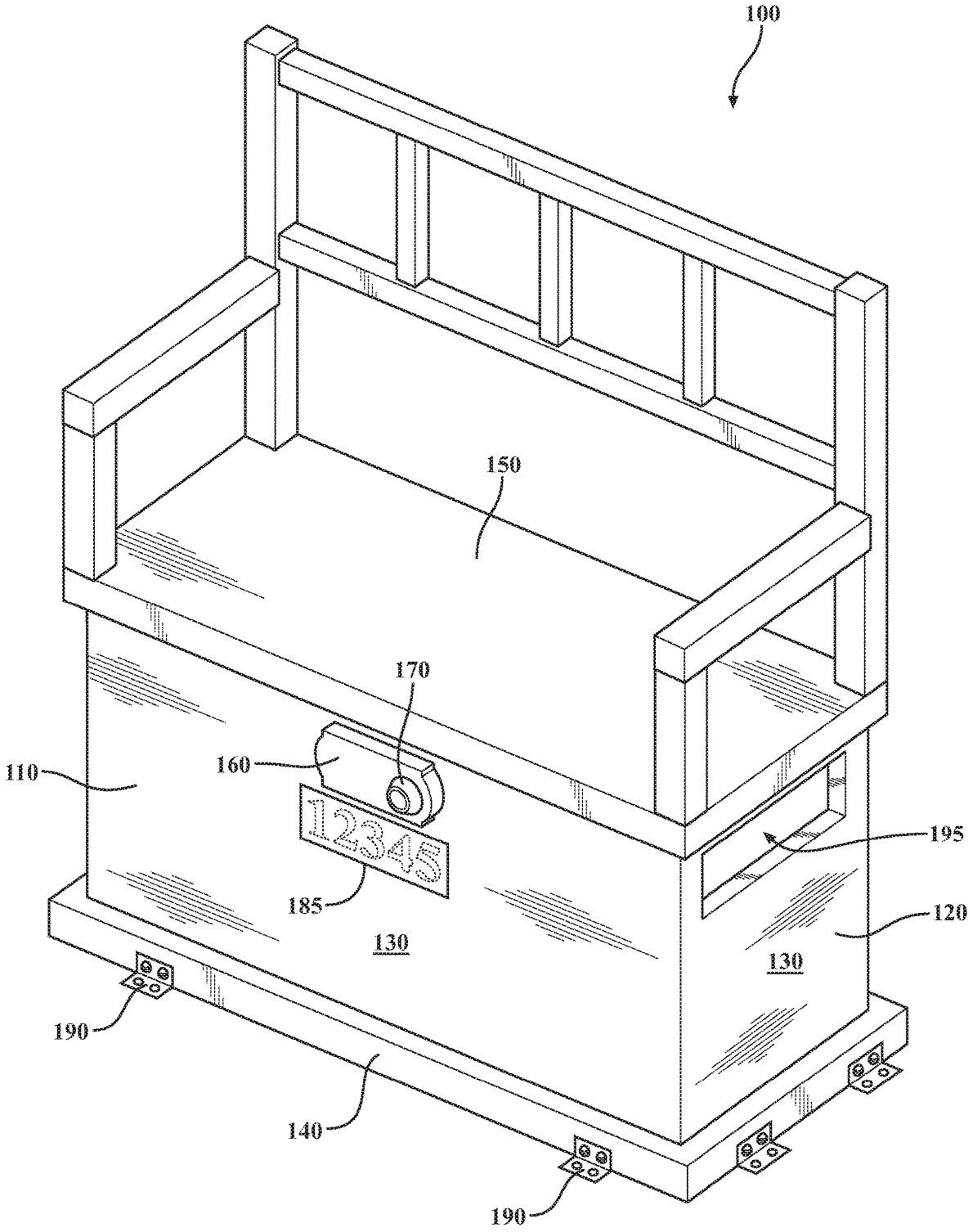
FIG. 12 is a perspective view of a secure package delivery container having an ornamental construction.

Referring now also to FIG. 12, in a non-limiting embodiment the secure package delivery container 100 is shown having an ornamental construction. In the immediate embodiment the container 100 has the appearance of a bench.

Figure 13:
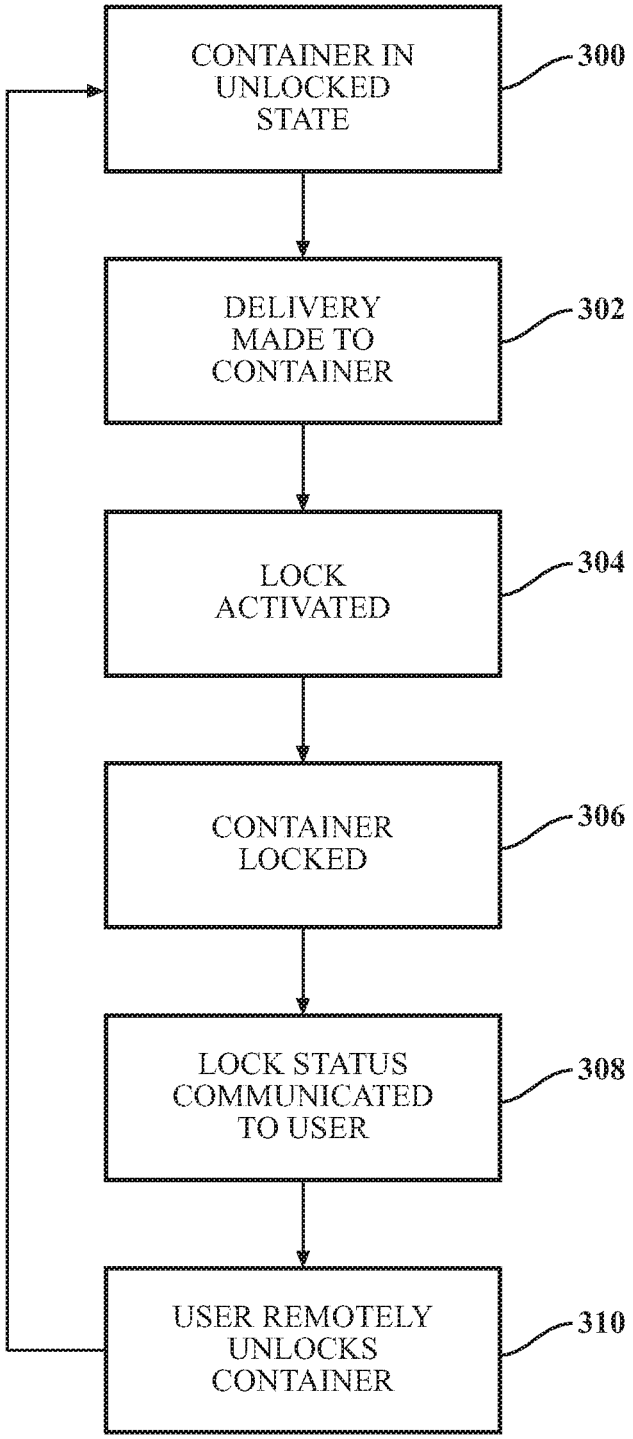
FIG. 13 is a flowchart of the method of the invention.

Referring now also to FIG. 13, in operation, the container 100 is initially in an unlocked state 300. Therefore, no credentials are needed to open the container 100 and put a package inside. A delivery 302 can then be made to the container 100. The delivery person has the option of activating 304 the locking device 160 with the lock activation device 170. If activated, the container is then in a locked state 306. The lock status is communicated 308 to the user of the system through the communications device 165 to an external device 173. The user is then aware that a package has been delivered and the container 100 is in a locked state. The user can then remotely unlock 310 the container 100 through the communications device 165 thus allowing for another delivery.

When a delivery is being made, external communications device 225 such as a microphone 230, camera 220 and/or motion detector 221 can be used to sense the presence of the delivery person preparing to make a delivery. The delivery person's presence can be communicated via the communications device 165 to an external device 173. The system user has ability to communicate with the delivery person and decide whether to unlock the door 150. Alternatively, the user can simply remotely unlock the container 100 when made aware there is a delivery in progress. This can be accomplished by the user receiving an email, telephone call, or text or having the camera 220 display a live feed of the delivery person to the user's smart phone or other device. Assuming that the user finds the delivery to be acceptable the door 150 is unlocked and the delivery is made. The delivery person can choose whether to lock the container 100 by activating the activation device 170, which in an embodiment is a button on the container.

The method can then be repeated for subsequent deliveries beginning with the step of the container being in an unlocked state 300. Thus, repeated deliveries may be made without the need of credentials to either unlock or lock the container 100. Advantageously, the container 100 does not automatically lock upon closure and instead can be locked by the lock activation device 170, or remotely through the communications device 165. This prevents the risk of a child unintentionally locking themselves inside the container 100. It also unburdens the delivery person from needing to know any credentials for unlocking or locking the container. This will aid in the efficient and more expedient delivery of packages since the delivery person will not need to spend time searching for or inputting credentials such as a key or code to open the container.

What is claimed is:

1. A secure package delivery container, comprising:

a container defining an enclosed storage volume, said container having a container body formed of at least one wall and a bottom, said container having a door operatively attached to said container body, said door being adapted to be moved from a closed position to an open position, wherein deliveries can be made into the container through the door;

an electronically controlled locking device for securing the door to the container body in the closed position, said electronically controlled locking device operable to be in an unlocked state and permit moving said door into the open position for making a delivery into the container by a delivery person, wherein said door is openable by the delivery person without any type of credential, and without an input from a user or any other source;

an electronically controlled lock activation device operably coupled to said electronically controlled locking device, said electronically controlled lock activation device adapted to receive input from the user at a remote location apart from the container and from the delivery person at the container and command said electronically controlled locking device to be in a locked state, wherein the electronically controlled lock activation device is adapted to operably allow the delivery person to lock the door in the closed position after making the delivery and without the any type of credential; and a communications device is in communication with said electronically controlled lock activation device and adapted to transmit signals to or receive signals from an external device, wherein said communications device operably allows the user to be in remote communication with the electronically controlled lock activation device, wherein said door is operably lockable and unlockable by the user, wherein said door is operably lockable in the closed position and not unlockable by the delivery person.

2. The secure package delivery container as set forth in claim 1, further comprising an opening device, said opening device operable to move said door into the open position or the closed position when said electronically controlled locking device is in an unlocked state.

3. The secure package delivery container as set forth in claim 2, wherein said communications device is adapted to transmit signals to or receive signals from said opening device, said communications device is in communication with said opening device to command said opening device to open or close the door.

4. The secure package delivery container as set forth in claim 2, wherein said opening device comprises a switch associated with said container.

5. The secure package delivery container as set forth in claim 2, wherein said opening device comprises a wireless device.

6. The secure package delivery container as set forth in claim 1, wherein said container further comprises a climate control system.

7. The secure package delivery container as set forth in claim 6, wherein said climate control system is a refrigeration or heating system.

8. The secure package delivery container as set forth in claim 1, wherein the container is collapsible.

9. The secure package delivery container as set forth in claim 8, wherein said wall of the container may be comprised of a plurality of sides, at least two of said sides are joined by a hinge.

10. The secure package delivery container as set forth in claim 1, further comprising a device for identifying the presence of an object in the container, wherein the device is selected from the group consisting of a light source, photodetector, IR LED and IR detector, a CMOS sensor, a load cell, proximity sensor, camera and microphone.

11. The secure package delivery container as set forth in claim 1, further comprising an external communications device.

12. The secure package delivery container as set forth in claim 1, further comprising a GPS sensor for determining the location of the container.

13. The secure package delivery container as set forth in claim 1, further comprising at least one of a magnetometer, gyroscope and accelerometer for determining the location of the container.

14. The secure package delivery container as set forth in claim 1, wherein said container further comprises a chute in said wall.

15. The secure package delivery container as set forth in claim 1, wherein said container is insulated.

16. The secure package delivery container as set forth in claim 1, further comprising hardware for securing said container in a location.

17. A secure package delivery container, comprising:

a container defining a storage volume, said container having a container body formed of at least one wall and a bottom, said container having a door operatively attached to said container body, said door being adapted to be moved from a closed to an open position without input of any type of credential by a delivery person making a delivery into the container;

a electronically controlled locking device for securing the door to the container body in the closed position, said electronically controlled locking device operable to be locked without the any type of credential;

a lock activation device operably coupled to said electronically controlled locking device, said lock activation device for receiving input from a user and commanding said electronically controlled locking device to be in a locked state; and a communications device in communication with said lock activation device and adapted to transmit signals to or receive signals from an external device, wherein the lock activation device comprises a locking switch external to the container, wherein activating the locking switch by the delivery person locks the container, wherein the electronically controlled locking device can be locked by activating the locking switch or by a signal to the lock activation device wherein the container is adapted to be unlocked without the any type of credential to receive delivery of a package and then be locked by the locking switch without the any type of credential.

18. A method for receiving delivery of packages to a container and remotely controlling the locking and unlocking of the container, the method comprising:

providing a container defining an enclosed storage volume, said container having a container body formed of at least one wall and a bottom, said container having a door operatively attached to said container body, said door being adapted to be moved from an open position to a closed position, wherein the container comprises an electronically controlled locking device for securing the door to the container body in the closed position, said electronically controlled locking device operable to be locked without any type of credential and upon an input from a user apart from a delivery person, wherein the electronically controlled locking device is in communication with an electronically controlled lock activation device for receiving input from the user or the delivery person and commanding said electronically controlled locking device to be in a locked state, wherein the electronically controlled lock activation device is in communication with a lock switch disposed in said container, wherein by triggering the lock switch the electronically controlled lock activation device will lock the door in the closed position without the any type of credential;

opening the door by the delivery person for making a delivery without the any type of credential;

closing the door wherein the door is unlocked;

allowing the door to be locked by either triggering the lock switch by the delivery person without the any type of credential or remotely locking the door by the user for securing the door to the container body in the closed position, wherein the door is locked without the any type of credential;

communicating the locked state to the user;

sensing the presence of a delivery person in proximity to the container body;

signaling the presence of the delivery person to the user through the communications device;

the user then remotely unlocking the door for receiving a second delivery; and repeating the steps beginning with opening the door by the delivery person for making a delivery without the any type of credential.

19. The method for receiving delivery of packages to a container and remotely controlling the locking and unlocking of the container of claim 18, wherein the sensing the presence of the delivery person is with at least one of a camera and a motion detector, wherein signaling the presence of the delivery person is with at least one of a text message, email and telephone communication.

* * * * *